United States Patent [19]

Briner et al.

[11] Patent Number: 4,854,118

[45] Date of Patent: Aug. 8, 1989

[54] METHOF OF, AND APPARATUS FOR, PRODUCING A FRICTION SPUN YARN

[75] Inventors: Emil Briner, Winterthur; Urs Keller, Seuzach; Herbert Stalder, Kollbrunn, all of Switzerland

[73] Assignee: Rieter Machine Works, Ltd., Winterthur, Switzerland

[21] Appl. No.: 167,026

[22] Filed: Mar. 11, 1988

Related U.S. Application Data

[62] Division of Ser. No. 789,902, Oct. 10, 1985, Pat. No. 4,753,066.

[30] Foreign Application Priority Data

Oct. 15, 1984 [CH] Switzerland ..... 04924/84

[51] Int. Cl.[4] ..... D01H 7/882

[52] U.S. Cl. ..... 57/401; 57/409

[58] Field of Search ..... 57/400, 401, 409, 411, 57/412, 413, 415

[56] References Cited

U.S. PATENT DOCUMENTS

| | | | |
|---|---|---|---|
| 3,757,507 | 9/1973 | Maxham | 57/401 |
| 3,864,902 | 2/1975 | Wehling et al. | 57/409 |
| 3,898,788 | 8/1975 | Fehrer | 57/411 X |
| 4,067,181 | 1/1978 | Fehrer | 57/412 |
| 4,241,574 | 12/1980 | Turk et al. | 57/401 X |
| 4,249,368 | 2/1981 | Fehrer | 57/401 X |
| 4,334,400 | 6/1982 | Fehrer | 57/401 |
| 4,567,723 | 2/1986 | Safar | 57/409 |
| 4,573,312 | 3/1986 | Brockmanns et al. | 57/411 X |
| 4,660,371 | 4/1987 | Stalder | 57/412 X |
| 4,753,066 | 6/1988 | Briner et al. | 57/401 |

FOREIGN PATENT DOCUMENTS

| | | | |
|---|---|---|---|
| 3330412 | 3/1985 | Fed. Rep. of Germany . | |
| 3330413 | 3/1985 | Fed. Rep. of Germany . | |
| 2345541 | 10/1977 | France | 57/401 |
| 623362 | 5/1981 | Switzerland . | |

*Primary Examiner*—Joseph J. Hail, III

*Attorney, Agent, or Firm*—Werner W. Kleeman

[57] ABSTRACT

The method of, and apparatus for, producing a yarn uses a friction spinning device comprising a perforated first friction spinning drum and a second friction spinning drum which can also be perforated. Two fiber feed passages project to the first friction spinning drum and are each supplied by opening assemblies which individualize or individually separate the fibers. The fibers are transported toward the first friction spinning drum using a feed air stream in the fiber passages. This feed air stream is produced by the first friction spinning drum which is maintained under sub-pressure. Advantageously, the fiber double-feed to the friction spinning drum permits supplying two different fiber types to the same yarn end. Also, different inclinations of the fibers at the friction spinning drum can be obtained by different inclinations of the fiber feed passages in order to produce yarns of different character. The first and second friction spinning drums can be each divided into cooperating drum sections to define a first pair of coacting drum sections and spaced therefrom a second pair of coacting drum sections. The respective pairs of drum sections can be operated at different rotational speeds and can be subjected to different vacuum conditions.

13 Claims, 8 Drawing Sheets

6
3
7
4
8
K
K
5
21
22
1
2
K
K
I
9
13
10
13
L
L
α
α
14
G
20
11
12
γ
γ
M
U
K
19
13.1
17
13.1
18

21;22
1;2
K
9;10
15a
11;12
19
23
15
24
14
S
U
U
16
M
15b
N 3
7
K
4
8
K
6
5
2
K
K
1
9
10
G
α
α
K
11
17
12
92
93
20
19
90
91

4
8
K
3
7
K
6
2
5
K
K
1
10
9
α
G
α
95
100
12
K
11
93
92
17
20
19
94
91
90

METHOF OF, AND APPARATUS FOR, PRODUCING A FRICTION SPUN YARN

CROSS-REFERENCE TO RELATED APPLICATIONS AND PATENTS

This application is a divisional of the commonly assigned, co-pending U.S. application Ser. No. 06/789,902, filed Oct. 10, 1985, and entitled "METHOD OF AND APPARATUS FOR PRODUCING A YARN" now U.S. Pat. No. 4,753,066, granted June 28, 1988, which, in turn, is related to the commonly assigned, U.S. application Ser. No. 06/734,845, filed May 15, 1985, and entitled "METHOD AND APPARATUS FOR PRODUCING A YARN", now U.S. Pat. No. 4,660,371, granted Apr. 28, 1987.

This application is related to the commonly assigned, co-pending U.S. application Ser. No. 07/155,956, filed Feb. 16, 1988, entitled "FRICTION SPUN YARN", now abandoned, application Ser. No. 07/167,029, filed Mar. 11, 1988, entitled "METHOD OF, AND APPARATUS FOR, PRODUCING A FRICTION SPUN YARN", now U.S. Pat. No. 4,773,209, granted Sept. 27, 1988.

BACKGROUND OF THE INVENTION

The present invention relates to a new and improved method of, and apparatus for, producing a yarn or the like.

In its more particular aspects, the present invention specifically relates to a new and improved method or producing a yarn or the like in which fibers are separated from a fiber strand and transferred to at least one friction spinning means at which a spun yarn is formed at least at one yarn forming position or location. During the step of forming the spun yarn, an air stream is drawn-in by suction through a perforated surface into the at least one friction spinning means and thereby the fibers are transferred to the perforated surface. The spun yarn thus formed is withdrawn in a predetermined withdrawal direction.

In a yarn spinning apparatus as known, for example, from Swiss Pat. No. 623,362 a device is provided for spinning a yarn according to the open-end friction-spinning principle. In accordance therewith, two perforated friction spinning drums which are maintained at sub-atmospheric pressure, spin a yarn from individualized fibers fed thereto in passages. The fibers are fed in respective passages to each spinning drum and in the direction of movement of the spinning drum, i.e. the fibers are delivered into both converging spaces. This has the disadvantage that the yarn forming position must be necessarily located at the narrowest place between the drums or rollers. As a result, the free space at this narrowest place is subjected to continuous variation due to the continually changing thickness of the yarn end located therein.

A further disadvantage of this apparatus is the necessity to perforate both friction spinning drums and subject both of the friction spinning drums to sub-atmospheric pressure or vacuum conditions in order to guide the fibers which are delivered onto the drums, to the yarn forming position or location in the related converging space.

Furthermore, such apparatus is very expensive and voluminous because of the delivery of fibers from both sides.

SUMMARY OF THE INVENTION

Therefore, with the foregoing in mind, it is a primary object of the present invention to provide a new and improved method of, and apparatus for, producing a yarn or the like and by means of which more than one fiber can be supplied per yarn formation in the simpleast possible manner.

Now in order to implement this and still further objects of the invention, which will become more readily apparent as the description proceeds, the yarn producing method of the present development is manifested by the features that, during the step of transferring the separated fibers to the at least one friction spinning means, the separated fibers are transferred at least at two fiber delivery locations in one predetermined or predeterminate direction to the friction spinning means.

According to more specific aspects of the invention, the method of producing a yarn or the like, comprises the steps of separating fibers from two fiber strands, wherein the separated fibers are transferred to two spacedly arranged friction spinning means each having a respective yarn forming location. The separated fibers may be transferred at different transfer rates to or towards related ones of the yarn forming locations. There is formed a friction spun yarn at the yarn forming locations of the two spacedly arranged friction spinning means.

The method may also be practiced such that the separated fibers are twisted in different twisting directions about yarn ends present at the related yarn forming location to thus form the friction spun yarn.

During the formation of the friction spun yarn, there is drawn in by suction an air stream through a respective perforated surface into each of the two spacedly arranged friction spinning means in order to thereby transfer the separated fibers to the perforated surfaces. The friction spun yarn is withdrawn in a predetermined yarn withdrawal direction, and during the step of transferring the separated fibers to the two spacedly arranged friction spinning means, there are transferred the separated fibers of the two fiber strands at least at two fiber delivery locations in a respective predetermined or predeterminate direction to each of the spacedly arranged friction spinning means.

As alluded to above, the invention is not only concerned with the aforementioned method aspects, but also relates to an improved construction of a yarn producing apparatus. Such apparatus, in its more specific aspects, contains at least two fiber separating means each of which contains a fiber delivery location for delivering fibers. There are further provided first friction spinning means and second friction spinning means which cooperate at a predetermined yarn forming location in order to form a spun yarn. Means are provided for generating an air stream which transfers the fibers from the fiber delivery location to a predetermined location at the first friction spinning means and at the second friction spinning means. The first friction spinning means and the second friction spinning means transport the fibers to the predetermined yarn forming location. Withdrawal means are provided for withdrawing the spun yarn in a predetermined yarn withdrawal direction.

According to the invention, the at lest two fiber separating means are arranged such that the fiber delivery locations are series-arranged with respect to the predetermined yarn withdrawal direction and that the fibers are delivered to the first friction spinning means at the predetermined location thereof.

In accordance with a particular construction of the apparatus for producing a yarn or the like the first friction spinning means and the second friction spinning means each constitute a friction spinning drum defining an axis. The first friction spinning drum and the second friction spinning drum are arranged with substantially parallel axes and in a nearly contacting relationship. The first friction spinning drum constitutes a perforated suction drum defining the perforated surface and containing a suction duct. The suction duct constitutes means for generating the air stream. Each one of the two friction spinning drums is sub-divided and forms related friction spinning drum sections. The friction spinning drum sections define pairs of cooperating friction spinning drum sections, and a related one of the fiber delivery locations are provided for each one of the pairs of the cooperating friction spinning drum sections.

It is one important advantage of the inventive method and apparatus that even for producing coarse yarns, e.g. of a count smaller than Ne 16, separation of the fiber sliver or strand which is fed to the separating or opening device or means, can be effected and enables individualization of the fibers prior to their deposition on the friction spinning device or means in a manner which is advantageous for the spinning process.

It is a further significant advantage of the inventive method and apparatus that, due to the series-arrangement of the fiber take-up positions as viewed from the yarn end, there exists the possibility of producing a friction spun yarn in which, for example, fibers of shorter staple length are located in the interior and fibers of greater staple length are located at the periphery of the yarn. In such a yarn, the fibers of greater staple length may also have a larger angle of inclination than the fibers of shorter staple length or vice versa. Furthermore, synthetic fibers can be located in the interior and natural fibers at the periphery of such friction spun yarn. Also, effect yarns can be produced in this manner.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
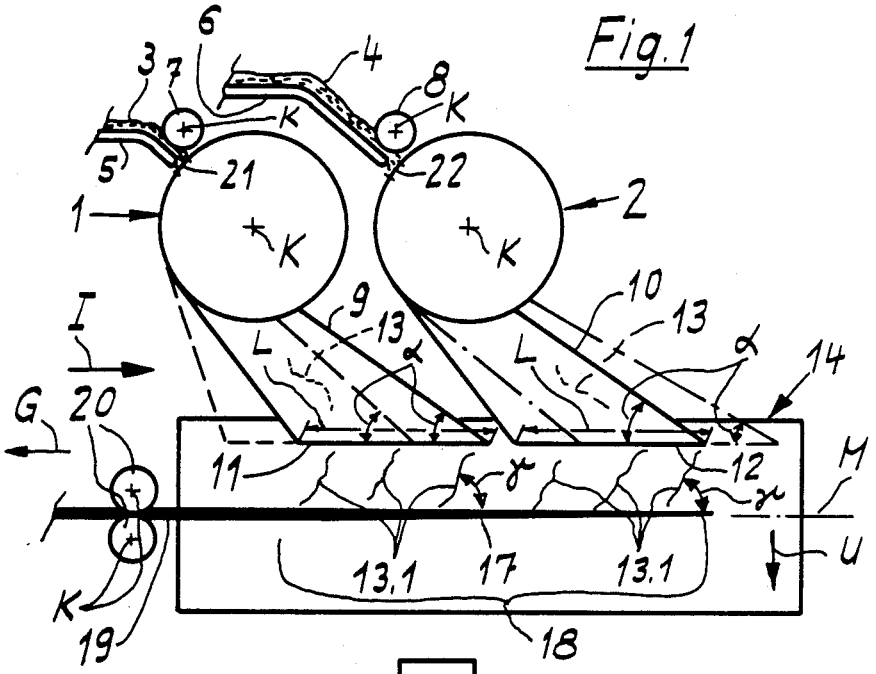
FIG. 1 is a partial and schematic, longitudinal view of a first exemplary embodiment of the apparatus according to the invention.

Describing now the drawings, it is to be understood that only enough of the construction of the apparatus for producing a yarn or the like has been shown as is needed for those skilled in the art to readily understand the underlying principles and concepts of this invention, while simplifying the showing of the drawings. Turning attention now specifically to FIG. 1, there is schematically and partially illustrated in a longitudinal view a first exemplary embodiment of the inventive yarn producing apparatus containing two separating or opening means or assemblies 1 and 2 which operate according to the known rotor open-end spinning method. Respective fiber slivers or strands 3 and 4 are fed to the separating or opening means 1 and 2. For this feeding operation, respective feed shoes 5 and 6 and respective feed rolls 7 and 8 are used. These elements are known as such and are commonly referred to as fiber feed elements.

The separating or opening means or assemblies 1 and 2 each comprise a separating or opening roll (not shown) provided with needles or teeth which respectively extract or separate fibers from the slivers or strands 3 and 4 and transfer the separated fibers to related fiber feed or transport passages 9 and 10 connected with the separating or opening means or assemblies 1 and 2. The separating or opening means or assemblies 1 and 2 are arranged in juxtaposed relationship as seen in the direction of the axes of rotation of their separating or opening rolls.

At related exit openings or ports 11 and 12 of the fiber feed or transport passages 9 and 10, the separated fibers 13 are delivered or transferred in a disposition which is indicated by the reference numeral 13.1, to the surface of first friction spinning means constituting a first friction spinning drum 14 which is known as such and the surface of which moves in the direction of the arrow U. The exit openings 11 and 12 of the fiber feed or transport passages 9 and 10 in the presently described embodiment of the inventive apparatus as well as corresponding exit openings or exit ports present in other embodiments described hereinafter, constitute or define related fiber delivery locations at which the separated fibers are transferred in one predetermined direction to the friction spinning means, i.e. to the first friction spinning drum 14 at predetermined locations or take-up locations thereof, during the operation of such apparatus.

Figure 2:
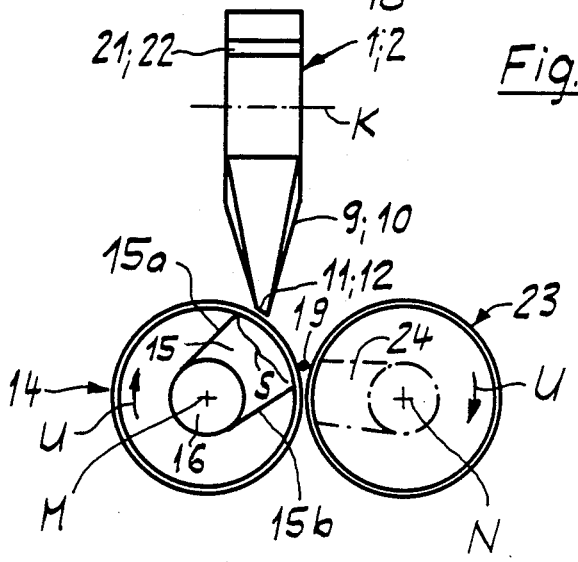
FIG. 2 is a side view in the direction I of a part of the apparatus shown in FIG. 1.

This first friction spinning drum 14 is suitably perforated (not shown) and is provided in its interior with a suction duct 15, see FIG. 2, which is known as such and which constitutes means for generating an air stream connected with a connector 16 and a source of sub-atmospheric pressure or vacuum (not shown). By means of this suction duct 15, air is drawn-in through the perforated first spinning drum 14 in a region S defined by duct walls 15*a* and 15*b*. An air stream or transporting air stream for the pneumatic fiber transfer or transport is thus drawn by suction through the pneumatic fiber feed or transport passages 9 and 10 and results in the fiber disposition designated 13.1. The separated fibers 13 are transferred or transported by the air stream to the friction spinning drum surface in a freely floating manner and are held at this surface by the drawn-in air. They are further transported to a yarn end 17 which is located at a predetermined yarn forming position or location 18. As a result, these fibers are taken up by the yarn end 17 and can be twisted to this yarn end.

A spun yarn or more specifically a friction spun yarn 19 thus is formed and withdrawn by withdrawal rolls 20 in a predetermined yarn withdrawal direction G. It is also to be noted from the showing of FIG. 1, for instance, that the separated fibers are transferred through the two separate fiber delivery locations defined by the exit openings or ports 11 and 12 in directions each having a direction component which is directed opposite to the yarn withdrawal direction G.

FIG. 2 does not shown the fiber feeding elements 5, 6, 7 and 8 and the fiber slivers or strands 3 and 4 but only shows openings 121 and 22 which are merely schematically indicated in FIG. 1 and respectively receive the fiber slivers or strands 3 and 4 at the separating or opening means or assemblies 1 and 2. This FIG. 2 shows second friction spinning means constituting a second friction spinning drum 23 which is known as such and which cooperates with the first friction spinning drum 14. This second friction spinning drum 23 may also be perforated and can be provided with a known suction duct 24. The first and second friction spinning drums 14 and 23 are arranged with parallel axes and in a nearly contacting relationship.

The friction spinning drums 14 and 23 are each rotatably and driveably arranged in known manner which is indicated in FIG. 1 by a dash-dotted line M and in FIG. 2 by respective crosses M and N. The rotatability and the driveability of the non-illustrated separating or opening rolls of the separating or opening means or assemblies 1 and 2 and of the feed rolls 7 and 8 and the withdrawal rolls 20 is also known as such, and is indicated hereinafter either by a respective cross and the designation K or by means of a dash-dotted line representing an axis with the designation K. The friction spinning means may be driven at a speed which exceeds the feed rate of the fibers to be transferred.

In FIG. 1 there is further illustrated by dotted or dash-dotted lines that the fiber feed or transport passages 9 and 10 can be provided at different or differently selected by equal inclinations relative to the predetermined or take-up location at the first friction spinning drum 14. This inclination is indicated by an angle $\alpha$. The lengths L of their exit openings are constant. The fibers are delivered to the perforated surface of the first friction spinning drum 14 such that the fibers 13 lie upon the perforated surface in a substantially straightened disposition at a predetermined rearward inclination angle $\gamma$ as seen in the predetermined yarn withdrawal direction G and are transferred to the predetermined yarn forming position or location 18 in such disposition. Under predetermined conditions taking into account the speed of movement in the direction U and the speed of the air or the fibers 13 in the region of the opening, the inclination of the fiber disposition 13.1 can be changed conjointly with the inclination angle $\alpha$ of the fiber feed or transport passages 9 and 10. The inclination of the fibers can be changed in such a manner that with decreasing angle $\alpha$ also the angle $\gamma$ becomes smaller. During manufacture of the yarn it is possible to produce, for example, the following different yarn types on the basis of such variations in the angle $\gamma$ of the fiber disposition 13.1 as well as on the basis of the illustrated double-feed and of the variants shown in FIGS. 14 to 18 still to be described hereinafter:

(i) A yarn comprising at least two substantially different staple lengths and in which the fibers of shorter staple length are provided in the interior and the fibers of greater staple length in the exterior region of the yarn cross-section.

(ii) A yarn which contains, in the inner region of its cross-section, synthetic fibers and natural fibers in the outer region.

(iii) Furthermore, a yarn in which the fibers in the inner region have a different angle of inclination or twist angle as compared to the fibers in the exterior region.

(iv) An effect yarn by periodic interruption of the delivery of the external fibers.

Figure 3:
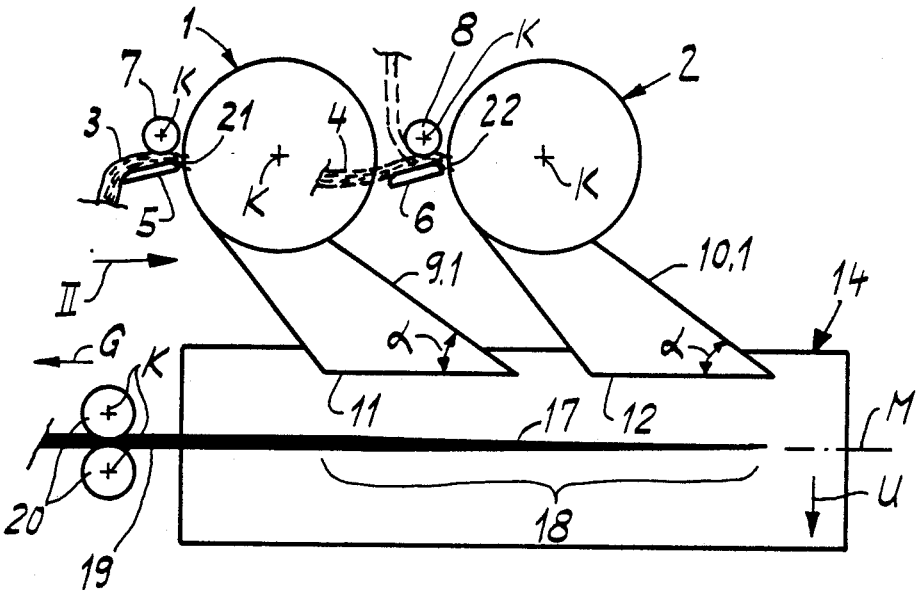
FIG. 3 is a view similar to FIG. 1 and shows a second exemplary embodiment of the inventive apparatus.
Figure 4:
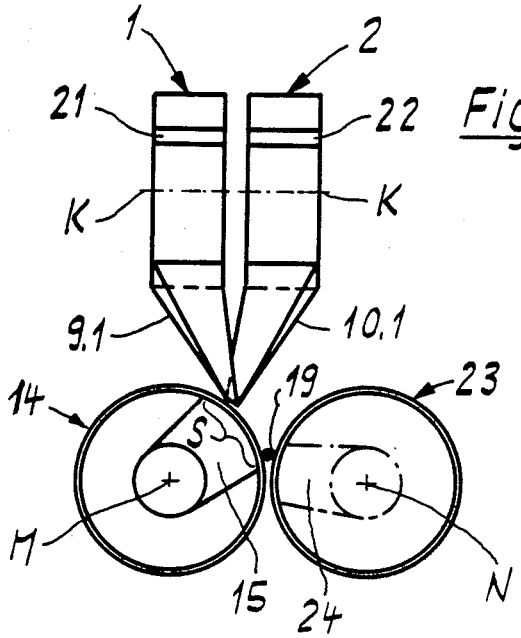
FIG. 4 is a side view in the direction II of a part of the apparatus shown in FIG. 3.

FIGS. 3 and 4 illustrate in views similar to FIGS. 1 and 2, a second exemplary embodiment of the inventive yarn producing apparatus which constitutes a variant of the apparatus illustrated in FIGS. 1 and 2. The difference is that the separating or opening means or assemblies 1 and 2 are arranged offset with respect to each other as viewed in the axial direction of the first friction spinning drum 14. As a result, the fiber slivers or strands 3 and 4 can be respectively applied substantially at the same height to the separating or opening means or assemblies 1 and 2.

In order to nevertheless series-arrange the exit openings 11 and 12 of the fiber feed or transport passages in this variant as viewed in the axial direction of the first friction spinning drum 14, these fiber feed or transport passages must be arranged inclined relative to each other in the manner illustrated in FIG. 4. The fiber feed or transport passage associated with the separating or opening means or assembly 1 is inclined to the right as viewed in FIG. 4 and designated by the reference numeral 9.1. The fiber feed or transport passage associated with the separating or opening means or assembly 2 is correspondingly inclined to the left and designated by the reference numeral 10.1.

In a non-illustrated variant of the apparatus shown in FIG. 4, the fiber feed or transport passages can be arranged without relative inclination in the manner illustrated in FIG. 2, so that the exit openings are arranged in a spaced relationship as viewed in axial direction of the first friction spinning drum. In such a variant, the feed or transport distance of the fibers delivered by the separating or opening means or assembly 1 to the first friction spinning drum 14 is positively greater than that of the fibers delivered by the separating or opening means or assembly 2.

Figure 5:
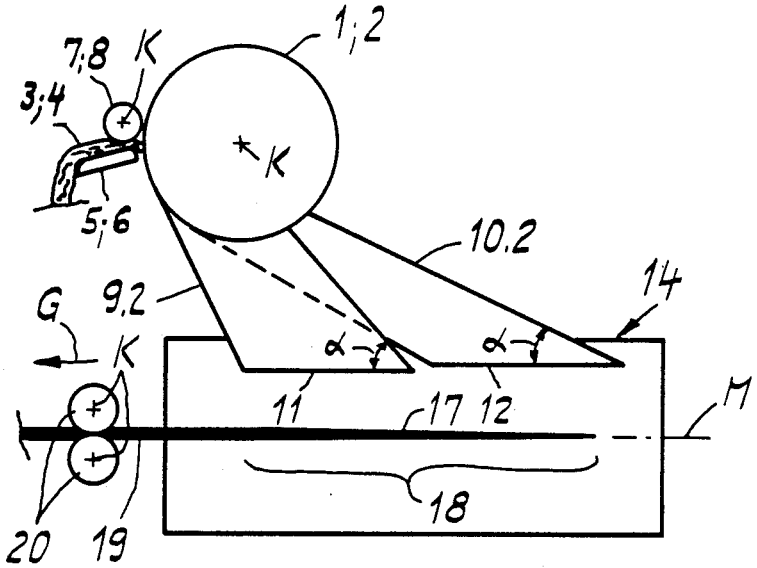
FIG. 5 is a view similar to FIG. 1 and shows a third exemplary embodiment of the inventive apparatus.
Figure 6:
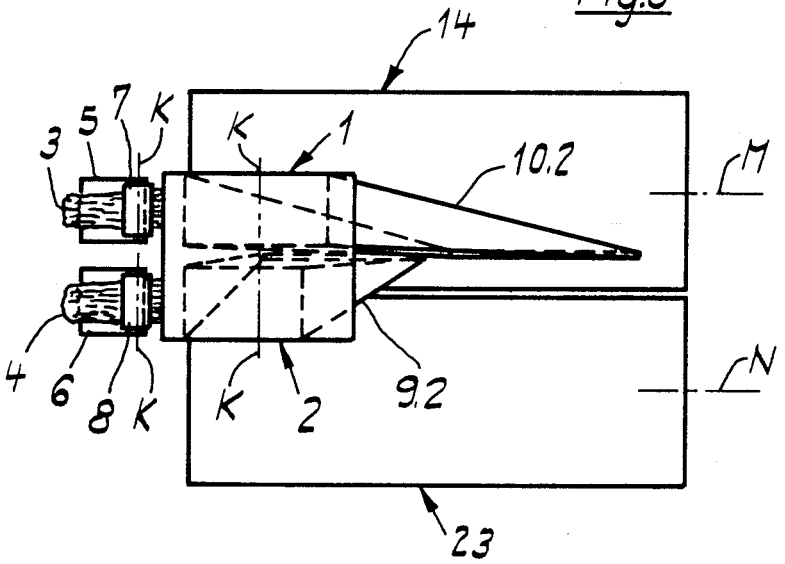
FIG. 6 is a plan view of the apparatus shown in FIG. 5.

FIGS. 5 and 6 illustrate a third exemplary embodiment of the inventive yarn producing apparatus which constitutes a second variant of the apparatus shown in FIGS. 1 and 2. In this variant, the separating or opening rolls or the assembled separating or opening means or assemblies 1 and 2 are coaxially arranged as seen in the direction of the axes of rotation of the separating or opening rolls.

Correspondingly, the fiber feed or transport passages designated by the reference numeral s9.2 and 10.2, are offset and arranged at an inclination relative to each other or at different inclinations relative to the predetermined or take-up location at the first friction spinning drum 14. Consequently, the exit openings or ports 11 and 12 are series arranged as viewed in the axial direction of the first friction spinning drum 14. The remaining elements shown in these Figures correspond to those of the apparatus shown in FIGS. 1 and 2.

For the sake of simplicity, the withdrawal rolls 20 and the spun yarn 19 have not been shown in FIG. 6.

As described with reference to FIG. 4, in a variant (not shown) the fiber feed or transport passages can be arranged without relative inclination, so that the exit openings or ports are arranged in a spaced relationship as viewed in the axial direction of the first friction spinning drum.

Figure 7:
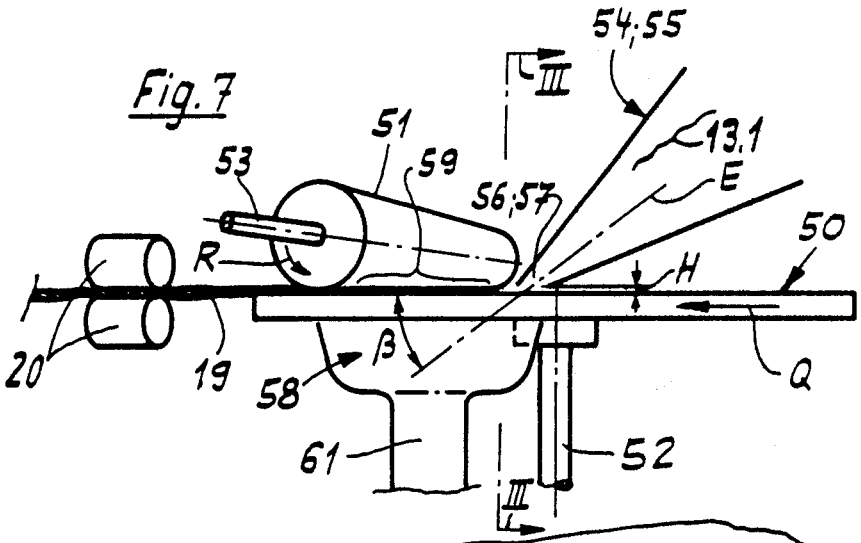
FIG. 7 is a schematic illustration of a fourth exemplary embodiment of the apparatus according to the invention.

FIG. 7 shows a fourth exemplary embodiment of the inventive yarn producing apparatus in which the first friction spinning means constitutes a friction spinning disc 50 and the second friction spinning means constitutes a conical, specifically a frusto-conical roll 51.

The friction spinning disc 50 is appropriately perforated (not shown) and is supported for rotation and driven in a direction Q by means of a shaft 52. Furthermore, the frusto-conical roll 51 has a closed exterior surface and is supported for rotation and driven in a direction R by means of a shaft 53.

Figure 8:
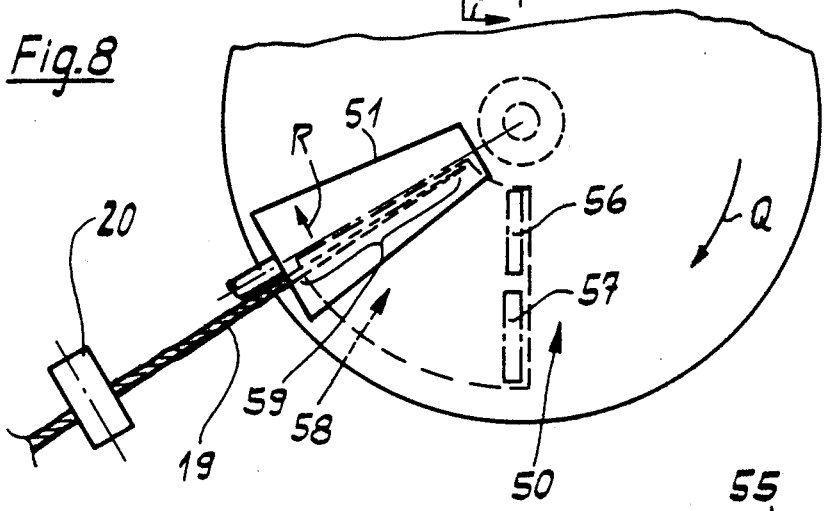
FIG. 8 is a partial plan view of the apparatus shown in FIG. 7.
Figure 9:
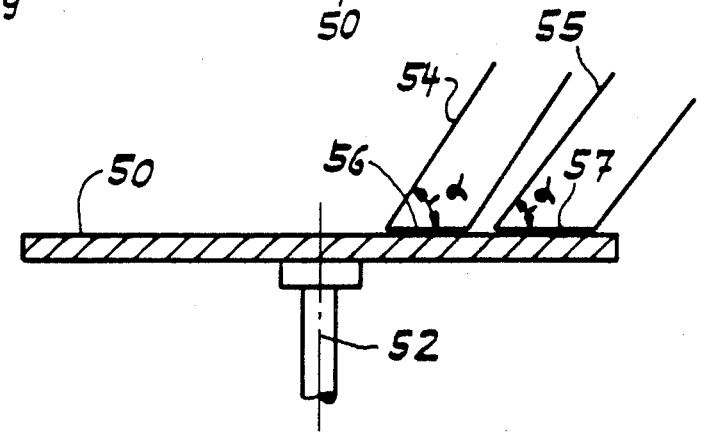
FIG. 9 shows a section along the line III—III in FIG. 7.

Two fiber feed or transport passages 54 and 55, of which only the passage 55 is shown in FIG. 7, are respectively connected with separating or opening means or assemblies 1 and 2 which are not illustrated in FIGS. 7 to 9 and which are of the type as described hereinbefore. Each of the passages 54 and 55 extends with its related exit opening 56 and 57 which are indicated by dash-dotted lines in FIG. 8, to the surface of the friction spinning disc 50 at a spacing H therefrom. As indicated by an angle $\beta$ in FIG. 7, the fiber feed or transport passages 54 and 55 are arranged in a rearwardly inclined disposition as viewed in the direction Q, above the friction spinning disc 50. The angle $\beta$ is formed by an imaginary plane of symmetry E defined by the fiber feed or transport passages 54 and 55 and the surface of the friction spinning disc 50.

A suction duct 58 is provided on the underside of the friction spinning disc 50 as viewed in the direction of the view of FIG. 7 or on a side which is remote from the frusto-conical roll 51. The fibers are delivered from the exit openings 56 and 57 to the friction spinning disc 50 as a result of the air flowing through the disc, and are transported on the disc which is moving in the direction Q to a predetermined yarn forming position or location 59 which is located in the converging space between the frusto-conical roll 51 and the friction spinning disc 50. At this yarn forming position or location 59, the fibers are twisted to form the spun yarn 19 which is withdrawn by means of the withdrawal rolls 20.

The suction passage 58 is connected with a suitable source (not shown) of sub-atmospheric pressure or vacuum by means of a connection tube 61.

In the apparatus embodiments described hereinbefore, the separated fibers which are delivered by the separating or opening means or assemblies, are pneumatically passed-on along a predetermined travel path to the first friction spinning means by means of the fiber feed or transport passages. In the further exemplary embodiments of the inventive yarn producing apparatus still to be described with reference to FIGS. 10 to 13, the fibers are, however, grasped already at their leading portions or sections by the first friction spinning means while the trailing portions or sections of the separated fibers are still held by the needles or teeth of the separating or opening rolls. Accordingly, the fibers thus never freely float throughout the entire process. The fibers are substantially mechanically guided along their travel path from the fiber slivers or strands 3 and 4 to their take-up at the first friction spinning means.

Figure 10:
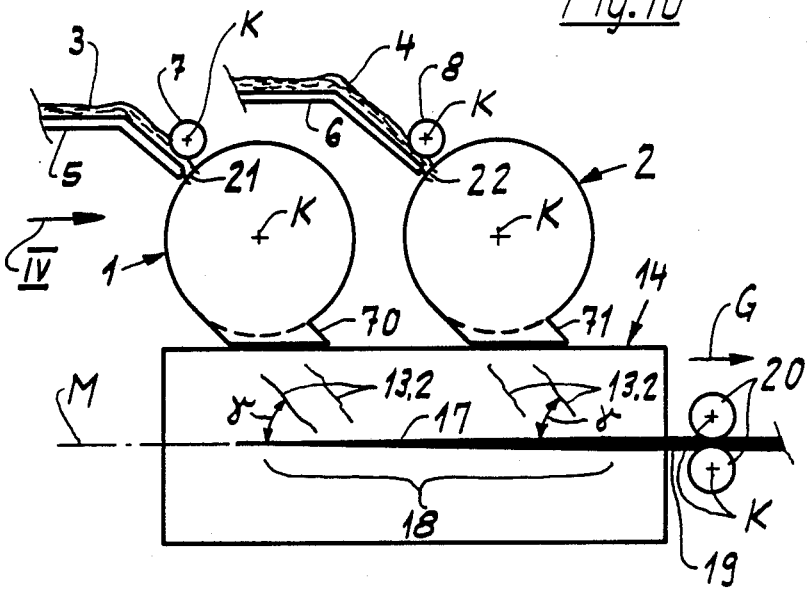
FIG. 10 is a view similar to FIG. 1 of a fifth exemplary embodiment of the apparatus according to the invention.
Figure 11:
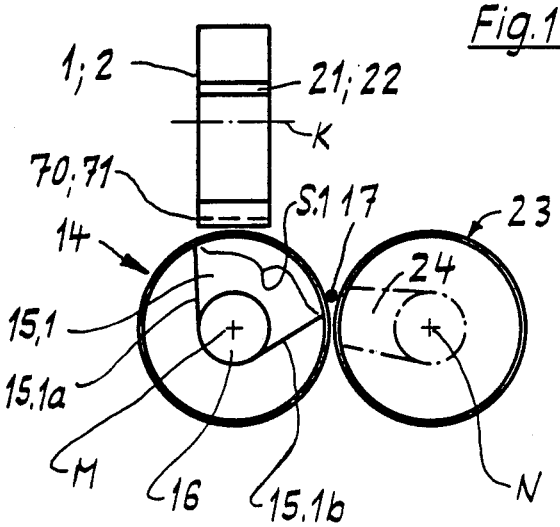
FIG. 11 is a partial side view in the direction IV of the apparatus shown in FIG. 10.

In the fifth exemplary embodiment shown in FIGS. 10 and 11, two opening devices 1 and 2 are provided immediately above the first friction spinning drum 14 and in series as viewed in the axial direction of the first friction spinning drum 14 such that the rotational axes K of the separating or opening rolls (not shown) are arranged parallel to each other.

Exit openings or ports 70 and 71 are respectively provided at the separating or opening means or assemblies 1 and 2 and form a fiber and air conducting connecting element between the separating or opening means or assemblies 1 and 2 and the first friction spinning drum 14. In this first friction spinning drum 14, a suction duct 15.1 is provided in a manner analogous to the embodiments described hereinbefore with reference to FIGS. 1 through 6. The duct 15.1 has walls 15.1*a* and 15.1*b* and thereby defines a suction zone S.1 at the first friction spinning drum 14 upon which the fibers are transported to the yarn end 17 at the yarn forming position or location 18.

As already described hereinbefore, the second friction spinning drum 23 can be provided with a suction duct 24 which is illustrated by dash-dotted lines in FIG. 11, provided that the second friction spinning drum 23 is also perforated. In the absence of this suction duct 24, the second friction spinning drum 23 has a continuous outer surface.

This suction duct 15.1 is connected with a non-illustrated source of sub-atmospheric pressure or vacuum by means of a suction port 16.

Figure 12:
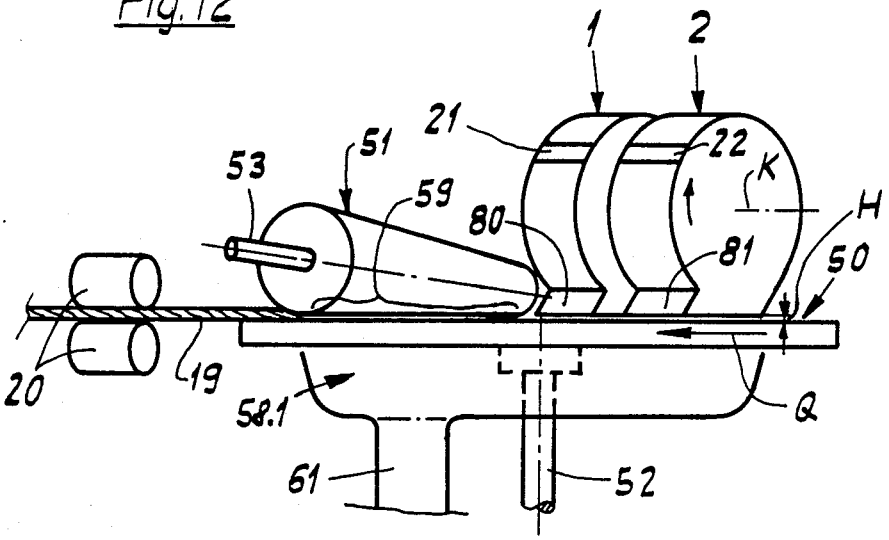
FIG. 12 is a view similar to FIG. 7 of a sixth exemplary embodiment of the apparatus according to the invention.
Figure 13:
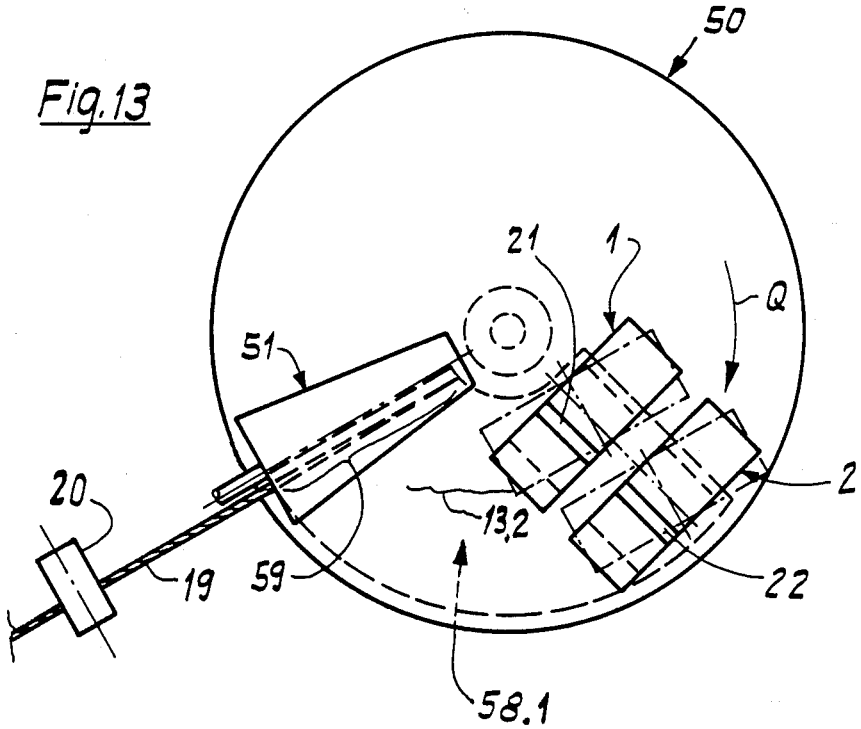
FIG. 13 is a partial plan view of the apparatus shown in FIG. 12.

FIGS. 12 and 13 show a sixth exemplary embodiment of the inventive yarn producing apparatus in which, in comparison to the apparatus shown in FIGS. 7 to 9 and instead of the fiber feed or transport passages 54 and 55, the separating or opening means or assemblies 1 and 2 are arranged directly above the surface of the friction spinning disc 50. Exit ports 80 and 81 respectively form exit openings of the separating or opening means or assemblies 1 and 2 directed to the surface of the friction spinning disc 50. The spacing between the exit ports 80 and 81 and the friction disc 50 amounts to a maximum of 1 mm and is designated by the reference character H.

The remaining elements correspond to those of the apparatus described hereinbefore with reference to FIGS. 7 to 9.

For simplicity in the illustration, of the fiber sliver or strand feed elements which comprise the feed rollers 7 and 8 and the feed shoes 5 and 6, only the feed openings 21 and 22 of the separating or opening means or assemblies 1 and 2 have been illustrated.

In operation, the friction spinning disc 50 has in the suction region of the suction duct 58.1, a surface speed which is the same as or which is slightly greater than the peripheral speed of the separating or opening rolls (not shown) of the separating or opening means or assemblies 1 and 2. As a result, the fibers substantially assume a disposition designated by reference numeral 13.2 in FIG. 13 and are fed in this disposition to the yarn forming position or location 59.

The axes K of the separating or opening rolls of the separating or opening means or assemblies 1 and 2 do not necessarily have to extend in radial direction; as indicated by dash-dotted lines in FIG. 13, these axes may also be arranged in a staggered relationship.

The conicity of the frusto-conical roll 51 is adapted to the radial decrease in the surface speed of the friction spinning disc 50 such that the peripheral speed of the frusto-conical roll 51 corresponds to this surface speed.

The spun yarn 19 which is formed at the yarn forming position or location 59 in the converging space between the frusto-conical roll 51 and the surface of the friction spinning disc 50, is withdrawn by the withdrawal roll pair 20.

Figure 14:
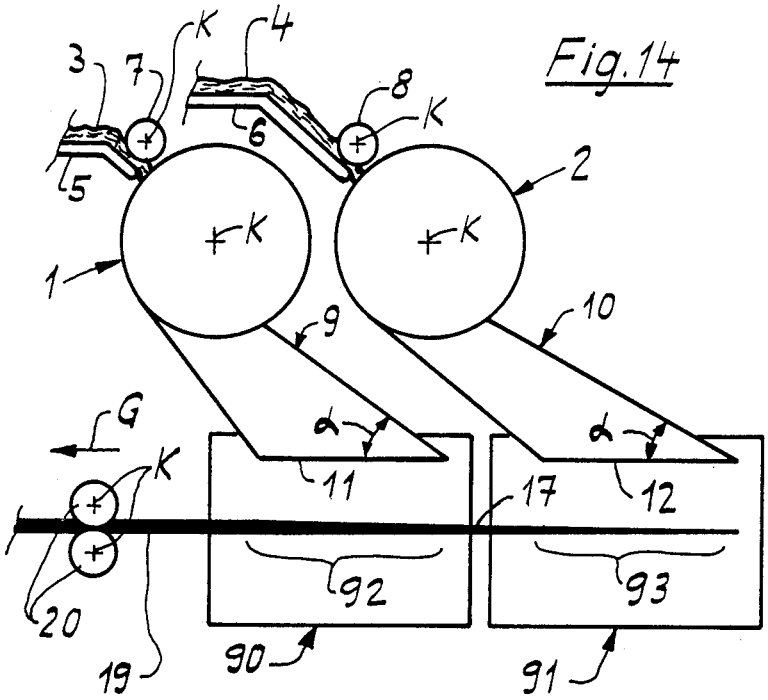
FIG. 14 is a view similar to FIG. 1 of a seventh exemplary embodiment of the apparatus according to the invention.

Furthermore, FIG. 14 shows a seventh exemplary embodiment of the inventive yarn producing apparatus. In this variant of the apparatus shown in FIGS. 1 and 2, the first and second friction spinning drums are each divided into two friction spinning drum sections which are rotatable and driveable independently from each other. In FIG. 14 only two friction spinning drum sections 90 and 91 are shown. There are formed pairs of cooperating first and second friction spinning drum sections and a fiber delivery location is provided at each such pair.

Furthermore, the spaced tandemly arranged friction spinning drum sections 90 and 91 are each equipped in their interior with a respective suction duct (not shown) which operates in a manner similar to the duct 15 illustrated in FIG. 2. Likewise and as described and illustrated with reference to FIGS. 1 and 2, the spaced tandemly arranged friction spinning drum sections which are not illustrated in FIG. 14 and which cooperate with the friction spinning drum sections 90 and 91, can be perforated and each equipped with a suction duct operating in a manner corresponding to the suction duct 24 shown in FIG. 2.

The drives or drive means for the friction spinning drum sections 90 and 91 and the axial intermediate space between such sections 90 and 91, are constructed such that the aforementioned suction ducts can be connected with not particularly shown sources of sub-atmospheric pressure or vacuum.

The remaining elements correspond to those of the apparatus shown in FIGS. 1 and 2.

During operation of the apparatus shown in FIG. 14, the separating or opening means or assembly 1 feeds fibers by means of the fiber feed or transport passage 9 to the friction spinning drum section 90 located closer to the withdrawal rolls 20. The separating or opening means or assembly 2 feeds fibers by means of the fiber feed or transport passage 10 to the friction spinning drum section 91 located farther from the withdrawal rolls 20.

Due to the independent drives and suction ducts of the friction spinning drum sections 90 and 91, there is the possibility of rotating the pairs of cooperating friction spinning drum sections with different rotational speeds and of subjecting the same to different sub-atmospheric pressures or vacuums. Depending upon the conditions, the fibers in the interior and the fibers in the exterior region of the cross-section of the spun yarn 19 can be provided with different twists, since not only the rotational speed of the friction spinning drum sections 90 and 91 but also the sub-atmospheric pressure or vacuum in their interiors is determinant for imparting the twist to the fibers at the yarn end. Furthermore, the width of the converging space formed by the two pairs of friction drum sections can be made variable and adjustable.

During build-up of the yarn, the fibers on the more distant friction spinning drum section 91 form the inner yarn region at a yarn forming position or location 93. The fibers on the closer friction spinning drum section 90 form the outer yarn region at the yarn forming position or location 92.

Figure 15:
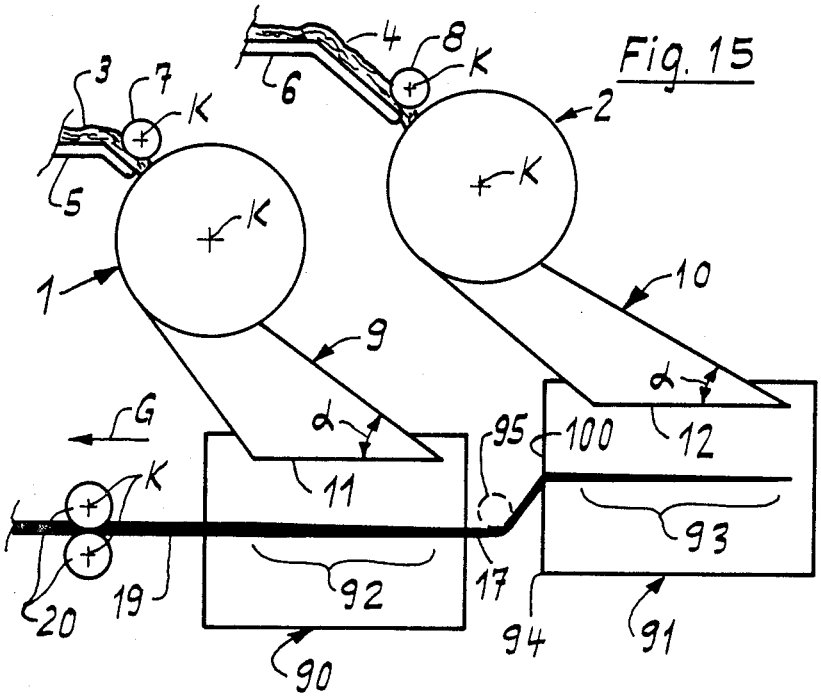
FIG. 15 illustrates a modification of the apparatus shown in FIG. 14.

A modification of the apparatus illustrating in FIG. 14 is shown in FIG. 15. In this modification, the pair of friction drum sections more distant from the withdrawal rolls 20 and of which in FIG. 15 only the friction spinning drum 91 is shown, is upwardly displaced or offset as viewed in the direction of viewing FIG. 15 in an axially parallel manner. As a result, the yarn portion produced at the associated yarn forming position or location 93, is drawn over the drum edges of which in FIG. 15, only the drum edge 100 of the friction spinning drum section 91 is shown. During withdrawal in the yarn withdrawal direction G.

A yarn guide element 95 can be provided between the two friction spinning drum section pairs in order to avoid even a partial lifting-off of this yarn portion toward the adjacent friction spinning drum sections as viewed in the yarn withdrawal direction G. In FIG. 15, only the friction spinning drum section 90 is shown.

The remaining elements correspond to the elements of the apparatus illustrated in FIG. 14.

By means of this "drawing over the drum edges" operation, an increase in the yarn tension is produced in the yarn portion between the withdrawal roll pair 20 and the more distant friction spinning drum section pair, which is desirable for the strengthening of the yarn structure. It will be understood, however, that such an arrangement is suitable only for fiber blends which can resist tearing of the yarn portion immediately after the drum edge 100 as viewed in the yarn withdrawal direction G. The suitability of such a yarn blend must therefore be established from case to case.

If desired, and in a further, non-illustrated variant, the more distant friction spinning drum section pair can be arranged lower than the closer friction spinning drum section pair as viewed in the direction of viewing FIG. 15. As a result, a braking effect arises at the front drum edges, as viewed in the yarn withdrawal direction G, at the drum section pair located closer to the withdrawal roll pair 20. In this manner, the yarn portion formed at the more distant yarn forming position or location 93 is not additionally loaded in the yarn withdrawal direction.

Furthermore, it will be understood that the aforementioned "drawing over the drum edges" operation can be carried out not only by means of the two aforementioned apparatuses. It is quite possible to offset the two drum pairs relative to each other in various other, non-illustrated fashions so that one of the two aforementioned braking effects arises. The rotational axes K of the drum section pairs must not always be arranged parallel to each other.

Figure 16:
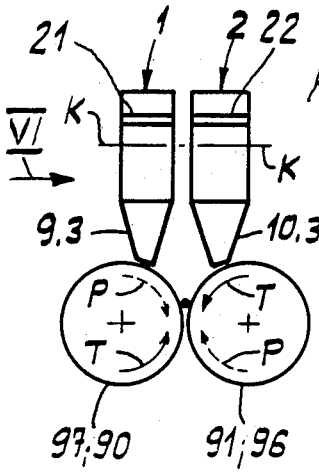
FIG. 16 is a view in the direction V in FIG. 17 of an eighth embodiment of the inventive apparatus.
Figure 17:
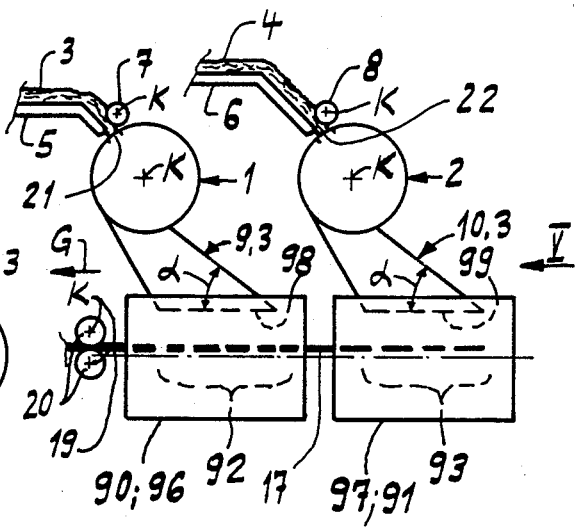
FIG. 17 is a view similar to FIG. 1 and in the direction VI in FIG. 16 of the apparatus shown in FIG. 16.
Figure 18:
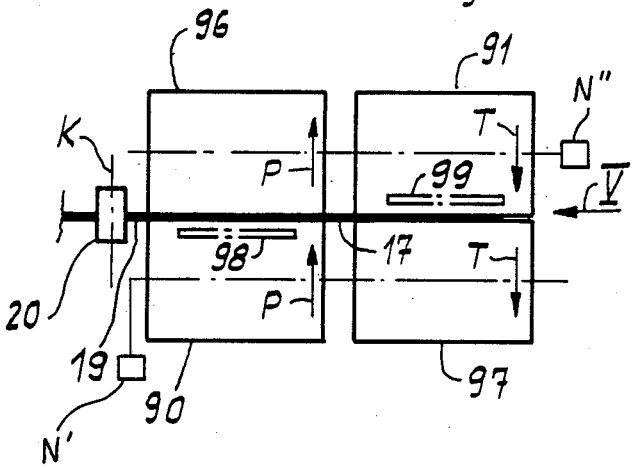
FIG. 18 shows a partial plan view of the apparatus shown in FIG. 17.

An eighth embodiment of the inventive yarn producing apparatus is illustrated in FIGS. 16 to 18 and produces a yarn in which the fibers located in the inner region have a twist direction which is opposite to the twist direction of the fibers located in the outer region of the yarn.

Apart from additional members, to be described hereinafter, the apparatus comprises components which were already described hereinbefore with reference to FIG. 14.

In addition to such components already described with reference to FIG. 14, there is shown in FIG. 18 a further friction spinning drum section 96 which cooperates with the friction spinning drum section 90, located closer to the withdrawal roll pair 20, and a further friction spinning drum section 97 which cooperates with the friction spinning drum section 91 located more distant from the withdrawal roll pair 20. Drive N' and N" are provided for respectively driving the drum sections 90 and 91.

It is further evident from FIGS. 16 and 18 that the direction of rotation P of the "closer located" friction spinning drum sections 90 and 96 is opposed to the direction of rotation T of the "more distant" friction spinning drum sections 91 and 97. Correspondingly and since the fiber feed or transport passages 9 and 10 always open toward the friction spinning drum sections 90 and 91 which transport the fibers into the related converging spaces, the related exit openings or ports 98 and 99 are arranged offset relative to each other as viewed in the direction of viewing FIG. 18. The fiber feed or transport passage directed towards the "closer located" friction spinning drum section 90 is designated by the reference numeral 9.3 and its exit opening or port by the reference numeral 98. The fiber feed or transport passage opening towards the "more distant" friction spinning drum section 91 is designated by the reference numeral 10.3 and its exit opening or port by the reference numeral 99.

Due to the aforementioned opposite rotational directions, the fibers which are delivered or supplied to the yarn forming positions are locations 92 and 93, are twisted into the spun yarn 19 in opposite twist directions.

A yarn produced in this manner exhibits no, or only a small snarling tendency.

The number of fibers in the inner and outer regions of the yarn can be varied by means of a variable fiber feed or transport arrangement.

While there are shown and described present preferred embodiments of the invention, it is to be distinctly understood that the invention is not limited thereto, but may be otherwise variously embodied and practiced without the scope of the following claims. Accordingly,

What we claim is:

1. A method of producing a yarn or the like, comprising the steps of:

separating fibers from two fiber strands;

transferring said separated fibers to two spacedly arranged friction spinning means each having a respective yarn forming location at different transfer rates towards related ones of said yarn forming locations;

forming a friction spun yarn at said yarn forming locations of said two spacedly arranged friction spinning means;

during said step of forming said friction spun yarn, drawing-in by suction an air stream through a respective perforated surface into each of said two spacedly arranged friction spinning means and thereby transferring said separated fibers to said perforated surfaces;

withdrawing said friction spun yarn in a predetermined yarn withdrawal direction;

during said step of transferring said separated fibers to said two spacedly arranged friction spinning means, transferring said separated fibers of said two fiber strands at least at two fiber delivery locations in a respective predeterminate direction to each of said spacedly arranged friction spinning means; and imparting different twist directions to the separated fibers at each respective yarn forming location.

2. The method as defined in claim 1, further including the step of:

rotating the two spacedly arranged friction spinning means in opposite directions of rotation in order to impart said different twist directions to the separated fibers at each respective yarn forming location.

3. A method of producing a yarn or the like, comprising the steps of:

separating fibers from two fiber strands;

transferring said separated fibers to two spacedly arranged friction spinning means each having a respective yarn forming location;

twisting said separated fibers in different twisting directions about yarn ends present at said related yarn forming locations and thus forming a friction spun yarn at said yarn forming locations of said two spacedly arranged friction spinning means;

during said step of forming said friction spun yarn, drawing-in by suction an air stream through a respective perforated surface into each of said two spacedly arranged friction spinning means and thereby transferring said separated fibers to said perforated surfaces;

withdrawing said friction spun yarn in a predetermined yarn withdrawal direction; and during said step of transferring said separated fibers to said two spacedly arranged friction spinning means, transferring said separated fibers of said two fiber strands at least at two fiber delivery locations in a respective predeterminate direction to each of said spacedly arranged friction spinning means.

4. The method as defined in claim 3, wherein:

said separated fibers of said two fiber strands are each transferred at each of said at least two fiber delivery locations in a respective predeterminate direction each having a direction component which is opposite to said predetermined yarn withdrawal direction.

5. The method as defined in claim 3, further including the step of:

rotating the two spacedly arranged friction spinning means in opposite directions of rotation in order to impart said different twisting directions to the separated fibers at each respective yarn forming location.

6. The method as defined in claim 3, further including the step of:

drawing the friction spun yarn over an edge of at least one predeterminate one of said two spacedly arranged friction spinning means in order to influence a selected property of the friction spun yarn.

7. An apparatus for producing a yarn or the like, comprising:

at least two separating means separating fibers from related fiber strands;

each one of said at least two separating means containing a fiber delivery location for delivering separated fibers;

at least two spacedly arranged friction spinning means operatively associated with said at least two separating means;

said at least two spacedly arranged friction spinning means defining at least two predetermined yarn forming locations in order to form a friction spun yarn;

means for generating at least one air stream for each said at least two spacedly arranged friction spinning means;

said air stream transferring said separated fibers from said fiber delivery locations to related predetermined locations at said friction spinning means;

said at least two spacedly arranged friction spinning means transporting said separated fibers from said related predetermined locations to said at least two predetermined yarn forming locations;

withdrawal means for withdrawing said friction spun yarn in a predetermined yarn withdrawal direction;

said at least two separating means being arranged such that said fiber delivery locations are series-arranged in spaced relationship from one another and such that said separated fibers are delivered to said at least two spacedly arranged friction spinning means at said related predetermined locations of said at least two spacedly arranged friction spinning means;

said at least spacedly arranged friction spinning means comprising first friction spinning means and second friction spinning means each constituting a friction spinning drum defining an axis;

said first friction spinning drum and said second friction spinning drum being arranged in spaced tandem relationship;

each said friction spinning drum constituting a perforated suction drum containing a suction duct;

each said suction duct constituting said means for generating said at least one air stream;

each one of said two friction spinning drums defining a related friction spinning drum section;

a related one of said fiber delivery locations being provided for each one of said friction spinning drum sections; and means for driving said friction spinning drum sections at different rotational speeds.

8. An apparatus for producing a yarn or the like, comprising:

at least two separating means separating fibers from related fiber strands;

each one of said at least two separating means containing a fiber delivery location for delivering separated fibers;

at least two spacedly arranged friction spinning means operatively associated with said at least two separating means;

said at least two spacedly arranged friction spinning means defining at least two predetermined yarn forming locations in order to form a friction spun yarn;

means for generating at least one air stream for each said at least two spacedly arranged friction spinning means;

said air stream transferring said separated fibers from said fiber delivery locations to related predetermined locations at said friction spinning means;

said at least two spacedly arranged friction spinning means transporting said separated fibers from said related predetermined locations to said at least two predetermined yarn forming locations;

withdrawal means for withdrawing said friction spun yarn in a predetermined yarn withdrawal direction;

said at least two separating means being arranged such that said fiber delivery locations are series-arranged in spaced relationship from one another and such that said separated fibers are delivered to said at least two spacedly arranged friction spinning means at said related predetermined locations of said at least two spacedly arranged friction spinning means;

said at least two spacedly arranged friction spinning means comprising first friction spinning means and second friction spinning means each constituting a friction spinning drum defining an axis;

said first friction spinning drum and said second friction spinning drum being arranged in spaced tandem relationship;

each said friction spinning drum constituting a perforated suction drum containing a suction duct;

each said suction duct constituting said means for generating said at least one air stream;

each one of said two friction spinning drums defining a related friction spinning drum section;

a related one of said fiber delivery locations being provided for each one of said friction spinning drum sections; and means for driving said friction spinning drum sections in a mutually offset relationship.

9. The apparatus as defined in claim 8, further including:

a yarn guide element; and said yarn guide element being arranged between said friction spinning drum sections.

10. An apparatus for producing a yarn or the like, comprising:

at least two separating means separating fibers from related fiber strands;

each one of said at least two separating means containing a fiber delivery location for delivering separated fibers;

at least two spacedly arranged friction spinning means operatively associated with said at least two separating means;

said at least two spacedly arranged friction spinning means defining at least two predetermined yarn forming locations in order to form a friction spun yarn;

means for generating at least one air stream for each said at least two spacedly arranged friction spinning means;

said air stream transferring said separated fibers from said fiber delivery locations to related predetermined locations at said friction spinning means;

said at least two spacedly arranged friction spinning means transporting said separated fibers from said related predetermined locations to said at least two predetermined yarn forming locations;

withdrawal means for withdrawing said friction spun yarn in a predetermined yarn withdrawal direction;

said at least two separating means being arranged such that said fiber delivery locations are series-arranged in spaced relationship from one another and such that said separated fibers are delivered to s said at least two spacedly arranged friction spinning means at said related predetermined locations of said at least two spacedly arranged friction spinning means;

said at least two spacedly arranged friction spinning means comprising first friction spinning means and second friction spinning means each constituting a friction spinning drum defining an axis;

said first friction spinning drum and said second friction spinning drum being arranged in spaced tandem relationship;

each said friction spinning drum constituting a perforated suction drum containing a suction duct;

each said suction duct constituting said means for generating said at least one air stream;

each one of said two friction spinning drums defining a related friction spinning drum section;

a related one of said fiber delivery locations being provided for each one of said friction spinning drum sections; and means for driving said spinning drum sections in opposite directions of rotation.

11. An apparatus for producing a yarn or the like, comprising:

at least two separating means for separating fibers from related fiber strands;

said at least two separating means containing at least two separate fiber delivery locations for separately and independently delivering separated fibers;

at least two spaced friction spinning means operatively associated with said at least two separating means and each having a perforated surface;

said at least two spaced friction spinning means defining respective predetermined yarn forming locations in order to form a friction spun yarn;

withdrawal means for withdrawing said friction spun yarn in a predetermined yarn withdrawal direction;

means for generating at least one air stream for said at least two spaced friction spinning means;

said at least one air stream transferring said separated fibers through said at least two separate fiber delivery locations to at least two associated fiber take-up positions on said perforated surfaces of said at least two spaced friction spinning means;

said at least two spaced friction spinning means transporting said separated fibers from said at least two fiber take-up positions to said respective predetermined yarn forming locations;

said at least two spaced friction spinning means transporting said separated fibers from said at least two fiber take-up positions to said respective predetermined yarn forming locations at predetermined fiber dispositions each of which is associated with one of said at least two fiber take-up positions and inclined relative to said predetermined yarn withdrawal direction;

said at least two separate fiber delivery locations being series-arranged with respect to said predetermined yarn withdrawal direction;

said at least two spaced friction spinning means transporting said separated fibers from said at least two fiber take-up positions to said respective predetermined yarn forming locations at predetermined dispositions each of which is associated with one of said at least two fiber take-up positions and in each of which said separated fibers assume a substantially straightened disposition at a predetermined angle of rearward inclination as viewed in said predetermined yarn withdrawal direction;

said at least two spaced friction spinning means comprising first friction spinning means and second friction spinning means each including at least one friction spinning drum arranged in axially spaced relationship with respect to each other;

a related one of said fiber delivery locations being provided for each one of said spaced friction spinning drums; and means for driving said friction spinning drums at different rotational speeds.

12. An apparatus for producing a yarn or the like, comprising:

at least two separating means for separating fibers from related fiber strands;

said at least two separating means containing at least two separate fiber delivery locations for separately and independently delivering separated fibers;

at least two spaced friction spinning means operatively associated with said at least two separating means and each having a perforated surface;

said at least two spaced friction spinning means defining respective predetermined yarn forming locations in order to form a friction spun yarn;

withdrawal means for withdrawing said friction spun yarn in a predetermined yarn withdrawal direction;

means for generating at least one air stream for said at least two spaced friction spinning means;

said at least one air stream transferring said separated fibers through said at least two separate fiber delivery locations to at least two associated fiber take-up positions on said perforated surfaces of said at least two spaced friction spinning means;

said at least two spaced friction spinning means transporting said separated fibers from said at least two fiber take-up positions to said respective predetermined yarn forming locations;

said at least two spaced friction spinning means transporting said separated fibers from said at least two fiber take-up positions to said respective predetermined yarn forming locations at predetermined fiber dispositions each of which is associated with one of said at least two fiber take-up positions and inclined relative to said predetermined yarn withdrawal direction;

said at least two separate fiber delivery locations being series-arranged with respect to said predetermined yarn withdrawal direction;

said at least two spaced friction spinning means transporting said separated fibers from said at least two fiber take-up positions to said respective predetermined yarn forming locations at predetermined dispositions each of which is associated with one of said at least two fiber take-up positions and in each of which said separated fibers assume a substantially straightened disposition at a predetermined angle of rearward inclination as viewed in said predetermined yarn withdrawal direction;

said at least two spaced friction spinning means comprising first friction spinning means and second friction spinning means each including at least one friction spinning drum arranged in axially spaced relationship with respect to each other;

a related one of said fiber delivery locations being provided for each one of said spaced friction spinning drums; and means for driving said friction spinning drums in opposite directions of rotation.

13. An apparatus for producing a yarn or the like, comprising:

at least two separating means for separating fibers from related fiber strands;

said at least two separating means continuing at least two separate fiber delivery locations for separately and independently delivering separated fibers;

at least two spaced friction spinning means operatively associated with said at least two separating means and each having a perforated surface;

said at least two spaced friction spinning means defining respective predetermined yarn forming locations in order to form a friction spun yarn;

withdrawal means for withdrawing said friction spun yarn in a predetermined yarn withdrawal direction;

means for generating at least one air stream for said at least two spaced friction spinning means;

said at least one air stream transferring said separated fibers through said at least two separate fiber delivery locations to at least two associated fiber take-up positions on said perforated surfaces of said at least two spaced friction spinning means;

said at least two spaced friction spinning means transporting said separated fibers from said at least two fiber take-up positions to said respective predetermined yarn forming locations;

said at least two spaced friction spinning means transporting said separated fibers from said at least two fiber take-up positions to said respective predetermined yarn forming locations at predetermined fiber dispositions each of which is associated with one of said at least two fiber take-up positions and inclined relative to said predetermined yarn withdrawal direction;

said at least two separate fiber delivery locations being series-arranged with respect to said predetermined yarn withdrawal direction;

said at least two spaced friction spinning means transporting said separated fibers from said at least two fiber take-up positions to said respective predetermined yarn forming locations at predetermined dispositions each of which is associated with one of said at least two fiber take-up positions and in each of which said separated fibers assume a substantially straightened disposition at a predetermined angle of rearward inclination as viewed in said predetermined yarn withdrawal direction;

said at least two spaced friction spinning means comprising first friction spinning means and second friction spinning means each including at least one friction spinning drum arranged in axially spaced relationship with respect to each other;

a related one of said fiber delivery locations being provided for each one of said spaced friction spinning drums;

each of said friction spinning drums being a perforated drum; and a respective drum member cooperating with each perforated drum to define respective pairs of drum members arranged in mutually spaced tandem relationship.

* * * * *

UNITED STATES PATENT AND TRADEMARK OFFICE

CERTIFICATE OF CORRECTION

PATENT NO. : 4,854,118

DATED : August 8, 1989

INVENTOR(S) : EMIL BRINER et al

It is certified that error appears in the above-identified patent and that said Letters Patent is hereby corrected as shown below:

Title page:

In the Abstract, line 9, after "fiber" please insert --feed--

Column 5, line 42, after "openings" please delete "121" and insert --21--

Column 6, line 9, after "disposition" please insert --and--

Column 11, line 27, after "Drive" please insert --means--

Column 13, line 44, after "least" please insert --two--

Signed and Sealed this

Twenty-first Day of August, 1990

*Attest:*

HARRY F. MANBECK, JR.

*Attesting Officer*

*Commissioner of Patents and Trademarks*